US010881939B2

(12) United States Patent
Youk

(10) Patent No.: US 10,881,939 B2
(45) Date of Patent: Jan. 5, 2021

(54) AUXILIARY APPARATUS FOR GOLF PUTTER

(71) Applicant: ALPION, CO., LTD., Seongnam-si (KR)

(72) Inventor: Keenseok Youk, Seongnam-si (KR)

(73) Assignee: ALPION, CO., LTD., Seongnam-si (KR)

( * ) Notice: Subject to any disclaimer, the term of this patent is extended or adjusted under 35 U.S.C. 154(b) by 0 days.

(21) Appl. No.: 16/761,281

(22) PCT Filed: Jan. 31, 2019

(86) PCT No.: PCT/KR2019/001320
§ 371 (c)(1),
(2) Date: May 4, 2020

(87) PCT Pub. No.: WO2019/151785
PCT Pub. Date: Aug. 8, 2019

(65) Prior Publication Data

US 2020/0289906 A1 Sep. 17, 2020

(30) Foreign Application Priority Data

Feb. 2, 2018 (KR) ..... 10-2018-0013406

(51) Int. Cl.
*A63B 69/36* (2006.01)
*F21V 23/04* (2006.01)
(Continued)

(52) U.S. Cl.
CPC ..... *A63B 69/3685* (2013.01); *F21V 23/0414* (2013.01); *F21V 33/008* (2013.01);
(Continued)

(58) Field of Classification Search
CPC ..... A63B 69/3685; A63B 69/3632; A63B 2071/0694; A63B 69/3676;
(Continued)

(56) References Cited

U.S. PATENT DOCUMENTS 5,207,429 A * 5/1993 Walmsley ..... A63B 69/3614 473/220
5,788,588 A * 8/1998 Hooker ..... A63B 69/3614 362/259
(Continued)

FOREIGN PATENT DOCUMENTS

JP 2006-255390 A 9/2006
KR 20-0292610 Y1 10/2002
(Continued)

*Primary Examiner* — Nini F Legesse
(74) *Attorney, Agent, or Firm* — Novick, Kim & Lee, PLLC; Sang Ho Lee

(57) ABSTRACT

Provided is an auxiliary apparatus for a golf putter including a coupling member detachably coupled to a shaft of the golf putter and a guide light emitting device coupled to the coupling member and configured to emit a guide light to help golf putting. The coupling member includes a first coupling member opened at upper and lower portions and one side thereof and detachably coupled to the golf putter through the opened space, and a second coupling member extending from the first coupling member and opened at upper and lower portions thereof, the second coupling member being configured to accommodate the guide light emitting device through the opened space.

7 Claims, 8 Drawing Sheets

(51) Int. Cl.
*F21V 33/00* (2006.01)
*A63B 102/32* (2015.01)

(52) U.S. Cl.
CPC ..... *A63B 2102/32* (2015.10); *A63B 2220/806* (2013.01); *A63B 2225/74* (2020.08)

(58) Field of Classification Search
CPC ..... A63B 2225/74; A63B 24/0003; A63B 53/007; A63B 2102/32; A63B 2220/806; A63B 69/36; G09B 19/0038; F21V 23/0414; F21V 33/008; F21V 33/00; F21V 23/04
USPC ..... 473/220
See application file for complete search history.

(56) References Cited

U.S. PATENT DOCUMENTS 5,964,668 A * 10/1999 Tai ..... A63B 69/3614 362/259
6,488,592 B1 * 12/2002 Boatner ..... A63B 69/3614 473/220
6,796,910 B1 * 9/2004 Foster ..... A63B 69/3614 473/220
6,840,869 B2 * 1/2005 Chen ..... A63B 69/3685 473/220
8,961,328 B1 * 2/2015 Schmok ..... G09B 19/0038 473/220
2001/0027136 A1 * 10/2001 Chris ..... A63B 69/3685 473/220
2002/0123385 A1 * 9/2002 Primiano ..... A63B 69/3632 473/220
2006/0287121 A1 * 12/2006 Cameron ..... A63B 69/3685 473/220
2015/0051008 A1 * 2/2015 Schmok ..... A63B 69/3614 473/220
2015/0265900 A1 * 9/2015 Vanacore ..... A63B 69/3676 473/221

FOREIGN PATENT DOCUMENTS

KR 10-0674029 B1 1/2007
KR 10-2016-0075076 A 6/2016
KR 10-1707766 B1 2/2017

* cited by examiner

AUXILIARY APPARATUS FOR GOLF PUTTER

TECHNICAL FIELD

The present disclosure relates to an auxiliary apparatus for a golf putter, and more particularly, to an auxiliary apparatus for guidance of golf putting.

BACKGROUND ART

Golf clubs used in golf include three woods used to blow a golf ball far away toward a hole, ten irons used to accurately move a golf ball to a position close to a hole cup, and one putter used to roll a golf ball into the hole cup at a location close thereto.

A golfer selects an appropriate club among these golf clubs and hits a golf ball. The movements for hitting a golf ball mostly include a swinging movement made by address, takeback, backswing, top swing, down swing, impact, follow-through and finish in order using a wood or iron, and a putting movement made by address and stroke in order using a putter.

In particular, when putting, a golfer closely observes the slope of the green, the direction of the grain, and the degree of bending of the green near the hole cup, and the distance and direction to the hole cup, draws a putting line to the hole cup, and then hit the golf ball while adjusting the hitting intensity appropriately.

Among the above factors for putting, the distance and direction to the hole cup are the most important factors, and the golfer makes putting by setting the distance and direction with accumulated experience according to repeated training. That is, if the distance to the hole cup is judged incorrectly, the hitting force is excessive or too small, so that the golf ball may pass over the hole cup or may not reach the hole cup.

In addition, if the direction is incorrectly judged, even if the hitting force is correct, the golf ball deviates from the hole cup.

In particular, beginners of golf also have considerable difficulty in judging the direction and distance to the hole cup, which are most basic factors, among the above putting factors.

Accordingly, there is a need for an auxiliary apparatus that is helpful in judging the direction and distance to the hole cup.

In addition, in golf, theoretically, the best effect may be obtained when the center of the golf ball is hit at a position perpendicular to the head surface of the club, but it is difficult to hit the golf ball while visually confirming that the club head surface makes contact perpendicular to the golf ball.

DISCLOSURE

Technical Problem

In order to solve the above technical problem, the present disclosure is directed to providing a guide light, which is coupled to a putter to help putting.

Technical Solution

An auxiliary apparatus for a golf putter may include a coupling member detachably coupled to a shaft of the golf putter, and a guide light emitting device coupled to the coupling member and configured to emit a guide light to help golf putting.

In addition, the coupling member may include a first coupling member opened at upper and lower portions and one side thereof and detachably coupled to the golf putter through the opened space, and a second coupling member extending from the first coupling member and opened at upper and lower portions thereof, the second coupling member being configured to accommodate the guide light emitting device through the opened space.

In addition, the guide light emitting device may include a housing, a battery located at one side inside the housing and configured to supply a power for operating the guide light emitting device, a light emitting unit configured to emit a guide light based on the supplied power, and a control unit configured to select a light emitting mode and control the light emitting unit so that the guide light is emitted to correspond to the light emitting mode.

In addition, the guide light emitting device may be detachably coupled in the opened space formed in the second coupling member and have a cylindrical shape elongated vertically. In addition, the guide light emitting device may be inserted into the second coupling member to be rotatable therein.

In addition, the housing may include a head portion having a first diameter and a body portion having a second diameter smaller than the first diameter, a button for controlling an operation of the guide light emitting device may be formed at an outer side of the head portion, the light emitting unit may be formed inside the body portion, and the battery may be positioned between the button and the light emitting unit.

In addition, the guide light emitting device may further include a lens located close to the light emitting unit to refract the guide light.

In addition, the control unit may select one light emitting mode according to a user input among a straight light emitting mode, a cross light emitting mode and a point light emitting mode, and emit a guide light corresponding to the selected light emitting mode.

In addition, the control unit may control the light emitting unit to adjust a line length of the guide light according to a distance between the auxiliary apparatus for a golf putter and the ground.

In addition, the auxiliary apparatus for a golf putter may further comprise a storage unit configured to store specifications of the golf putter.

In addition, the control unit may control the light emitting unit to adjust a direction of the guide light based on the stored specifications of the golf putter.

In addition, the auxiliary apparatus for a golf putter may further comprise a photographing unit configured to photograph an image for golf putting, and the control unit may generate a slow motion image corresponding to the photographed image and store the slow motion image in a storage unit.

Advantageous Effects

The present disclosure has an advantageous effect to help putting by providing a guide light.

More specifically, in the present disclosure, since a guide light is provided to display a distance from a golf ball to a hole cup, a user may intuitively grasp the distance between the golf ball and the hole cup.

In addition, in the present disclosure, since the guide light is provided in consideration of at least one of surrounding weather information, golf course information and golf club specifications, it is possible to provide a more accurate guide light.

Moreover, in the present disclosure, since an image for golf putting is provided, the user may closely check the moving direction of the golf ball and the path of the putter head.

BEST MODE

Provided is an auxiliary apparatus for a golf putter, comprising:

a coupling member detachably coupled to a shaft of the golf putter; and a guide light emitting device coupled to the coupling member and configured to emit a guide light to help golf putting, wherein the coupling member includes:

a first coupling member opened at upper and lower portions and one side thereof and detachably coupled to the golf putter through the opened space; and a second coupling member extending from the first coupling member and opened at upper and lower portions thereof, the second coupling member being configured to accommodate the guide light emitting device through the opened space, wherein the guide light emitting device includes:

a housing;

a battery located at one side inside the housing and configured to supply a power for operating the guide light emitting device;

a light emitting unit configured to emit a guide light based on the supplied power; and a control unit configured to select a light emitting mode and control the light emitting unit so that the guide light is emitted to correspond to the light emitting mode, wherein the guide light emitting device is detachably coupled in the opened space formed in the second coupling member and has a cylindrical shape elongated vertically, and the guide light emitting device is inserted into the second coupling member to be rotatable therein.

MODE FOR DISCLOSURE

The following is merely illustrative of the principles of the invention. Therefore, a person skilled in the art may implement various principles and various devices included in the concept and scope of the invention, although not explicitly described or illustrated in the specification. In addition, all conditional terms and examples listed in this specification are in principle intended only to help understanding of the concept of the invention, and should be considered as not restrictive to the specifically listed embodiments and conditions.

The above objects, features and advantages will become more apparent through the following detailed description in connection with the accompanying drawings, and accordingly, those skilled in the art to which the invention pertains can easily implement the technical idea of the invention.

In addition, in describing the invention, when it is judged that the detailed description of any known technology associated with the invention may unnecessarily obscure the subject matter of the invention, the detailed description will be omitted. Hereinafter, a preferred embodiment of the present disclosure will be described in detail with reference to the accompanying drawings.

Figure 1:
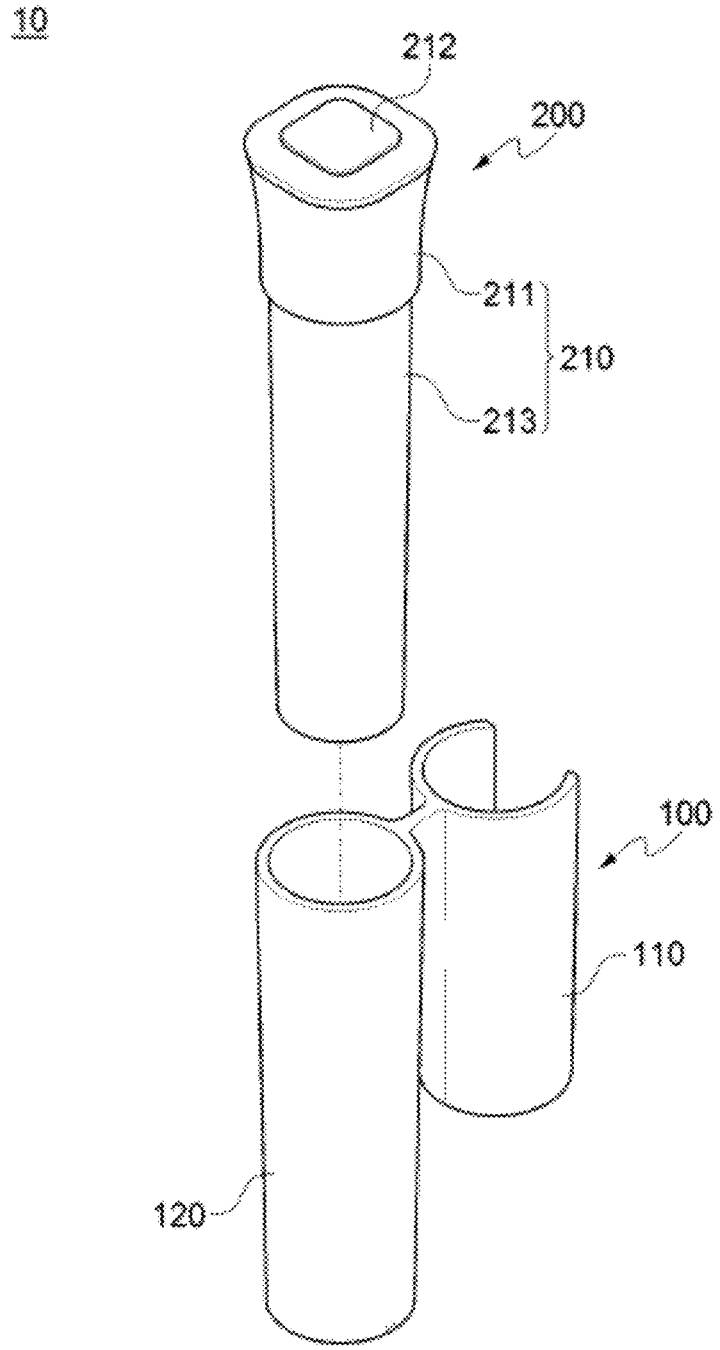
FIG. 1 is a diagram showing an auxiliary apparatus for a golf putter according to an embodiment of the present disclosure.

FIG. 1 is a diagram showing an auxiliary apparatus 10 for a golf putter according to an embodiment of the present disclosure.

Figure 2:
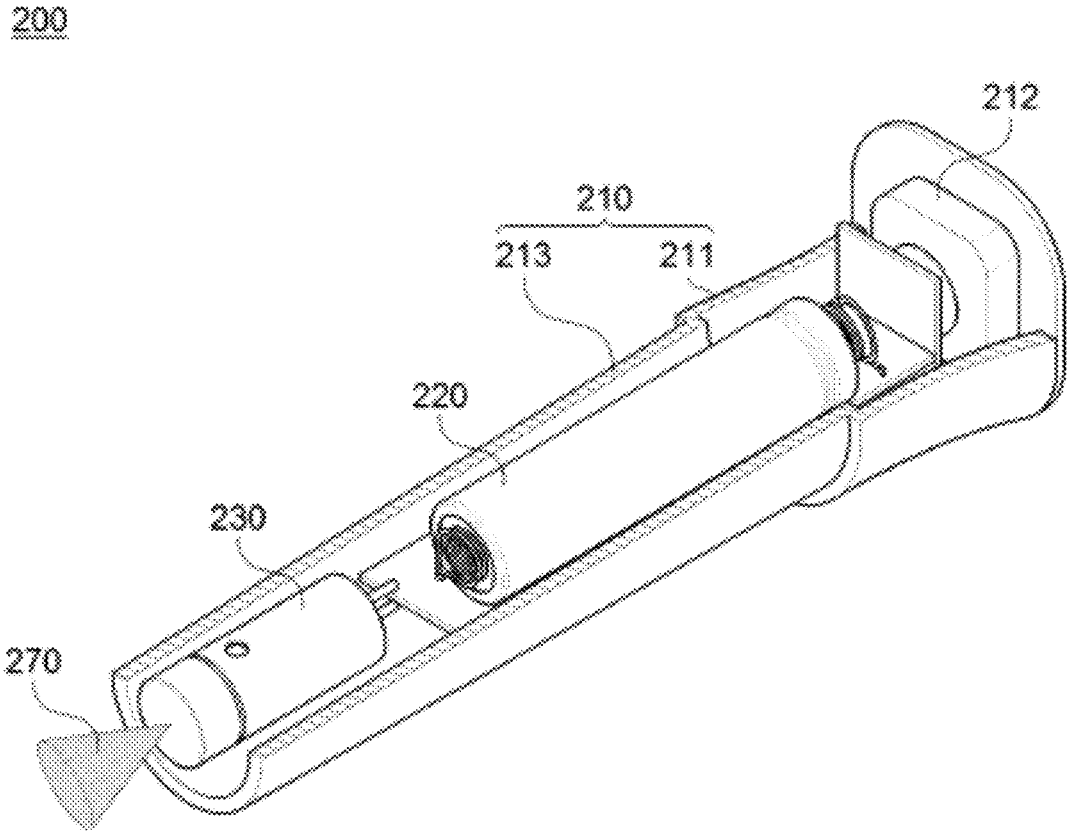
FIG. 2 is a sectional view showing the auxiliary apparatus for a golf putter according to an embodiment of the present disclosure.

FIG. 2 is a sectional view showing the auxiliary apparatus 10 for a golf putter according to an embodiment of the present disclosure.

Referring to FIGS. 1 and 2, the auxiliary apparatus 10 for a golf putter may include a coupling member 100 detachably coupled to a shaft of the golf putter and a guide light emitting device 200. The guide light emitting device 200 may be coupled to the coupling member 100 and emit a guide light to help golf putting.

The coupling member 100 may include a first coupling member 110 having a cylindrical shape opened at upper and lower portions and one side thereof and detachably coupled to the shaft of the golf putter, and a second coupling member 120 extending from the first coupling member 110 and having a cylindrical shape opened at upper and lower portions thereof, the second coupling member 120 being configured to accommodate the guide light emitting device 200 through the opened space.

When a user gives a strong force, the coupling member 100 may be coupled to the shaft and rotated. Therefore, the user may couple the coupling member 100 at a desired position of the shaft in a desired direction.

The first coupling member 110 may further include a friction member (not shown) formed at an inner surface thereof to prevent the first coupling member 110 from randomly rotating on the shaft of the golf putter. Here, the friction member (not shown) may be made of a rubber material.

The guide light emitting device 200 may have a cylindrical shape elongated in a vertical direction and be detachably coupled in the opened space formed in the second coupling member 120. In addition, the guide light emitting device 200 may include a housing 210, a button 212, a battery 220, a light emitting unit 230, and a lens 270.

The housing 210 forms the outer shape of the guide light emitting device 200 and may include a head portion 211 having a first diameter and a body portion 213 having a second diameter smaller than the first diameter. Here, the head portion 211 may have a structure rotatable at the body portion 213. Since the head portion 211 rotates at the body portion 213, the direction of the guide light may be adjusted.

The button 212 for controlling an operation of the guide light emitting device 200 may be formed at an outer side of the head portion 211. Here, the button 212 may serve to turn on (ON) or turn off (OFF) the power of the guide light emitting device 200. Also, the button 212 may serve to receive a command for selecting a light emitting mode from the user. Here, the light emitting mode is a mode provided by the guide light emitting device 200, and the light emitting mode may include a straight light emitting mode, a cross light emitting mode and a point light emitting mode. The specific light emitting modes will be described later.

When the guide light emitting device 200 is accommodated in the second coupling member 120, the body portion 213 of the guide light emitting device 200 is inserted into the second coupling member 120 and functions as a member for locking the head portion 211. At this time, the guide light emitting device 200 may rotate inside the second coupling member 120. That is, the guide light emitting device 200 may be inserted into the second coupling member 120 and rotatable therein about a vertical axis.

Therefore, the user may rotate the guide light emitting device 200 around the vertical axis in a state where the guide light emitting device 200 is coupled to the second coupling member 120. Through this, when the guide light is not emitted to the ground at a desired angle, the user may accurately position the guide light by rotating the guide light emitting device 200 in the second coupling member 120 around the vertical axis.

In addition, an elastic member (not shown) may be further provided to the outer side of the body portion 213 or the inner side of the second coupling member 120. Through this, it is possible to prevent the guide light emitting device 200 from easily rotating arbitrarily inside the second coupling member 120 due to vibration or shock that may occur during use.

In addition, the battery 220, the light emitting unit 230, and the lens 270 will be described below.

Subsequently, the battery 220, the light emitting unit 230, the lens 270, and additional internal components will be described in detail with reference to FIG. 3.

Figure 3:
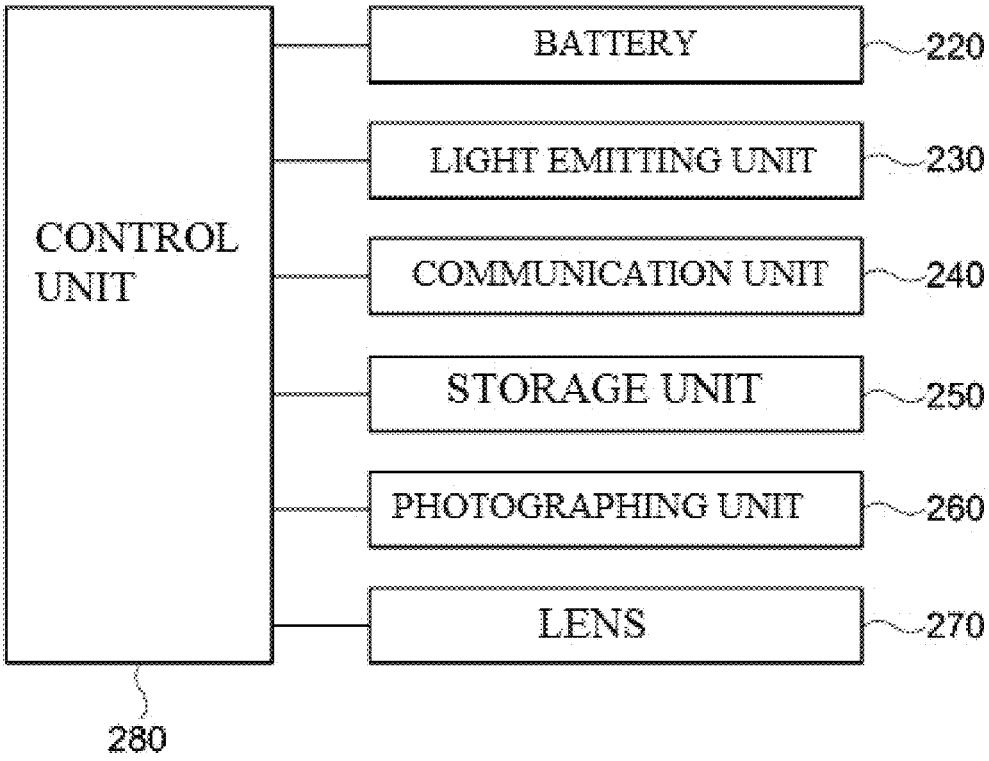
FIG. 3 is a block diagram showing a guide light emitting device according to an embodiment of the present disclosure.

FIG. 3 is a block diagram showing the guide light emitting device 200 according to an embodiment of the present disclosure.

The guide light emitting device 200 may include a battery 220, a light emitting unit 230, a lens 270, a communication unit 240, a storage unit 250, and a photographing unit 260.

The battery 220 is located inside the housing 210 and may supply power for operating the guide light emitting device 200. That is, battery 220 may be located between the button 212 and the light emitting unit 230 to supply power for operations of the light emitting unit 230, the communication unit 240, the storage unit 250, the photographing unit 260, and the like.

In addition, the battery 220 may include a plurality of battery cells (not shown) connected in series and in parallel. The battery cells (not shown) may be rechargeable secondary batteries such as nickel-cadmium batteries, lead-acid batteries, nickel-hydride batteries (NiMH), lithium ion batteries, and lithium polymer batteries.

The light emitting unit 230 may be located inside the body portion 213 and emit a guide light to help putting based on the power supplied from the battery 220. Here, the guide light may serve to indicate a direction of a golf ball. That is, the guide light may indicate an expected path of the golf ball. In addition, the guide light may serve to correct the posture of the golfer during the putting operation. That is, when the posture of the golfer is shaken or the head of the golfer is shaken during the putting motion, the guide light may also be shaken. Accordingly, the golfer may check the degree of shaking of the guide light and correct the posture.

In addition, the light emitting unit 230 may emit the guide light differently according to the light emitting mode. Here, the light emitting mode may be one of a straight light emitting mode, a cross light emitting mode and a point light emitting mode.

In this regard, detailed examples of light emitting mode will be described with reference to FIGS. 4 and 5.

Figure 4:
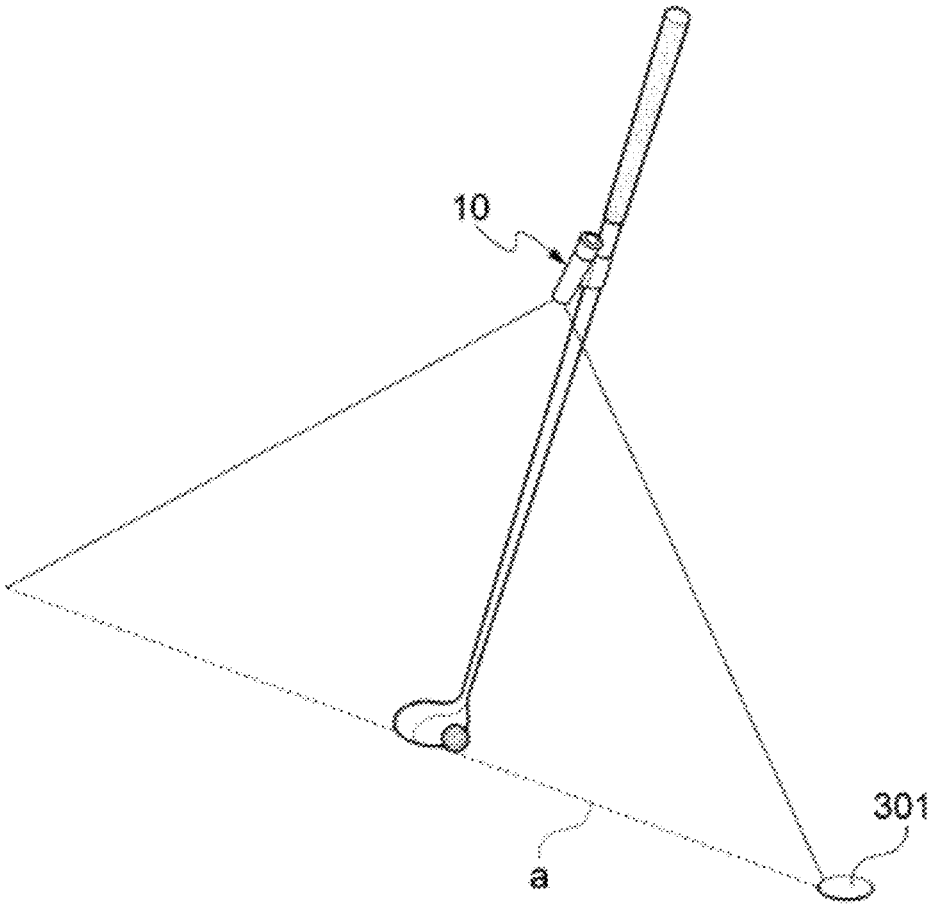
FIG. 4 is a diagram showing a point light emitting mode of a guide light emitting device according to an embodiment of the present disclosure.

FIG. 4 is a diagram showing a point light emitting mode of the guide light emitting device 200 according to an embodiment of the present disclosure.

Figure 5:
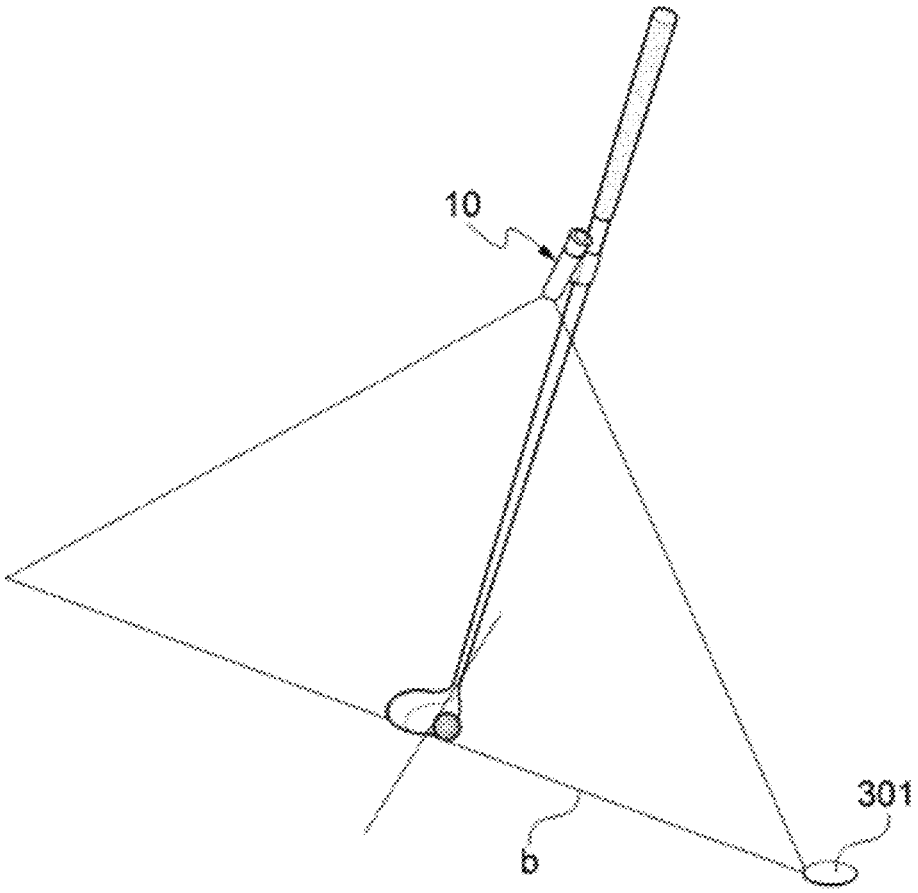
FIG. 5 is a diagram showing a cross light emitting mode of the guide light emitting device according to an embodiment of the present disclosure.

FIG. 5 is a diagram showing a cross light emitting mode of the guide light emitting device 200 according to an embodiment of the present disclosure.

Referring to FIG. 4, if the light emitting mode is the point light emitting mode, the light emitting unit 230 may emit a guide light as indicated by (a). That is, in the point light emitting mode, the light emitting unit 230 may emit the guide light in the form of successive points. In addition, although not shown in the figure, in the straight light emitting mode, the light emitting unit 230 may emit the guide light in the form of a continuous straight line.

In addition, referring to FIG. 5, if the light emitting mode is the cross light emitting mode, the light emitting unit 230 may emit the guide light as indicated by (b). That is, in the cross light emitting mode, the light emitting unit 230 may emit the guide light indicating a cross close to the head of the putter. That is, in the cross light emitting mode, the guide light may include a first line formed toward the hole cup and a second line formed perpendicular to the first line. In this case, during the putting process, the golfer may confirm whether the putter head hits the golf ball accurately by checking whether the head surface of the putter hits the golf ball perpendicular to the first line and parallel to the second line.

Meanwhile, the above light emitting modes are just examples, and the present disclosure may further include an additional light emitting mode.

Referring to FIG. 3 again, the light emitting unit 230 may change the color of the guide light based on a control command. At this time, it is preferable to change the color of the guide light into a complementary color of the green. The complementary color means colors located opposite to each other in the color wheel. Also, the user may preset a range of complementary colors.

For example, if the green has a green color, the light emitting unit 230 may change the color of the guide light into purple, which is the complementary color of green.

By changing the color of the guide light into the complementary color of green, it is possible to provide a clearer guide light to the user.

The communication unit 240 may serve to perform wired/wireless communication with a mobile device of the user or a peripheral device. Here, the peripheral device may be a laptop, a tablet, or the like.

For example, the communication unit 240 may transmit and receive a photographed image to/from the mobile device or the peripheral device. In addition, the communication unit 240 may transmit and receive a control command to/from the mobile device or the peripheral device. Here, the control command may be a control command for selecting a light emitting mode.

As another example, the communication unit 240 may receive putter or golf club specifications from the peripheral device or the mobile device, and the communication unit 240 may receive surrounding weather information of a golf course from the peripheral device, the mobile device, or a weather station server.

The communication unit 240 may be implemented as a wired/wireless communication module that performs wired or wireless communication through a local area network (LAN) or an Internet network, a USB interface module that communicates through a Universal Serial Bus (USB) port, a mobile communication module that accesses and communicates with a mobile communication network according to various mobile communication standards such as 3G (3rd Generation), 3GPP (3rd Generation Partnership Project) and LTE (Long Term Evolution), and a short-range wireless communication module such as Wi-Fi and Bluetooth.

The storage unit 250 may serve to store information or data received by the communication unit 240. The received information or data may be putter or golf club specifications, golf course information, surrounding weather information of a golf course, or the like. The putter or golf club specifications may include elasticity or a loft angle, and the golf course information may include a ground angle or a turf condition of each course. In addition, the surrounding weather information may include information such as wind or temperature.

In addition, the storage unit 250 may also serve to store the image photographed by the photographing unit 260. Here, the storage unit 250 may be implemented with a storage medium of at least one of a built-in storage element such as RAM (Random Access Memory), flash memory, ROM (Read Only Memory), SRAM (Static Random Access Memory), EPROM (Erasable Programmable ROM), EEPROM (Electronically Erasable and Programmable ROM), a register, a hard disk, a removable disk, a memory card, a magnetic memory, an optical disk, as well as a detachable storage element such as a USB memory.

The photographing unit 260 may serve to photograph an image for golf putting. In addition, the image for golf putting photographed by the photographing unit 260 may be transmitted to the mobile device or the peripheral device through the communication unit 240. In addition, the photographing unit 260 may photograph the image for golf putting based on a control command of the user. Here, the photographing unit 260 may be installed toward the ground to generate a moving image for golf putting that includes movements of the guide light and the putter head formed on the ground.

The image for golf putting may be usefully used for putting correction of a golfer. Specifically, since the image for golf putting may include the guide light and the putter head, the golfer may correct the putting posture by checking whether the putter head hits the golf ball correctly by means of the corresponding image. For example, if the guide light is a day light, the golfer may correct the putting posture by checking whether the head surface of the putter hits the golf ball perpendicular to the guide light through the corresponding image.

In addition, since the golfer may confirm whether the golf ball moves along the guide light through the photographed image for golf putting, it is helpful for putting.

The lens 270 may be located close to the light emitting unit 230 to refract the guide light. Specifically, the lens 270 may be refracted so that the guide light emitted from the light emitting unit 230 spreads widely. Here, the lens 270 may use a convex lens or a concave lens, preferably a concave lens.

In addition, the lens 270 may further include an angle adjusting member (not shown) that may adjust the angle of the lens. The lens 270 may adjust the degree of refraction that the guide light spreads by adjusting the angle of the lens.

The control unit 280 may serve to control the overall operation of the internal configuration of the guide light emitting device 200.

Specifically, the control unit 280 may select one light emitting mode among the straight light emitting mode, the cross light emitting mode and the point light emitting mode according to a user input. In addition, the control unit 280 may control the light emitting unit 230 to emit a guide light corresponding to the selected light emitting mode.

In addition, the control unit 280 may determine a distance between the auxiliary apparatus for a golf putter and the ground, and control the light emitting unit 230 or the lens 270 so that the line length of the guide light is adjusted according to the determined distance between the auxiliary apparatus for a golf putter and the ground. Also, the control unit 280 may control the light emitting unit 230 or the lens 270 such that the line length of the guide light is proportional or inversely proportional to the distance between the auxiliary apparatus for a golf putter and the ground.

For example, if the distance between the auxiliary apparatus for a golf putter and the ground increases, the control unit 280 may control the light emitting unit 230 so that the length of the guide light is increased. In addition, if the distance between the auxiliary apparatus for a golf putter and the ground increases, the control unit 280 may control the angle adjustment member (not shown) of the lens 270 so that the length of the guide light increases.

In addition, the control unit 280 may control the light emitting unit 230 or the lens 270 so that the length and position of the guide light are not changed even when the golf club moves during putting.

This will be described in detail with reference to FIG. 6.

Figure 6:
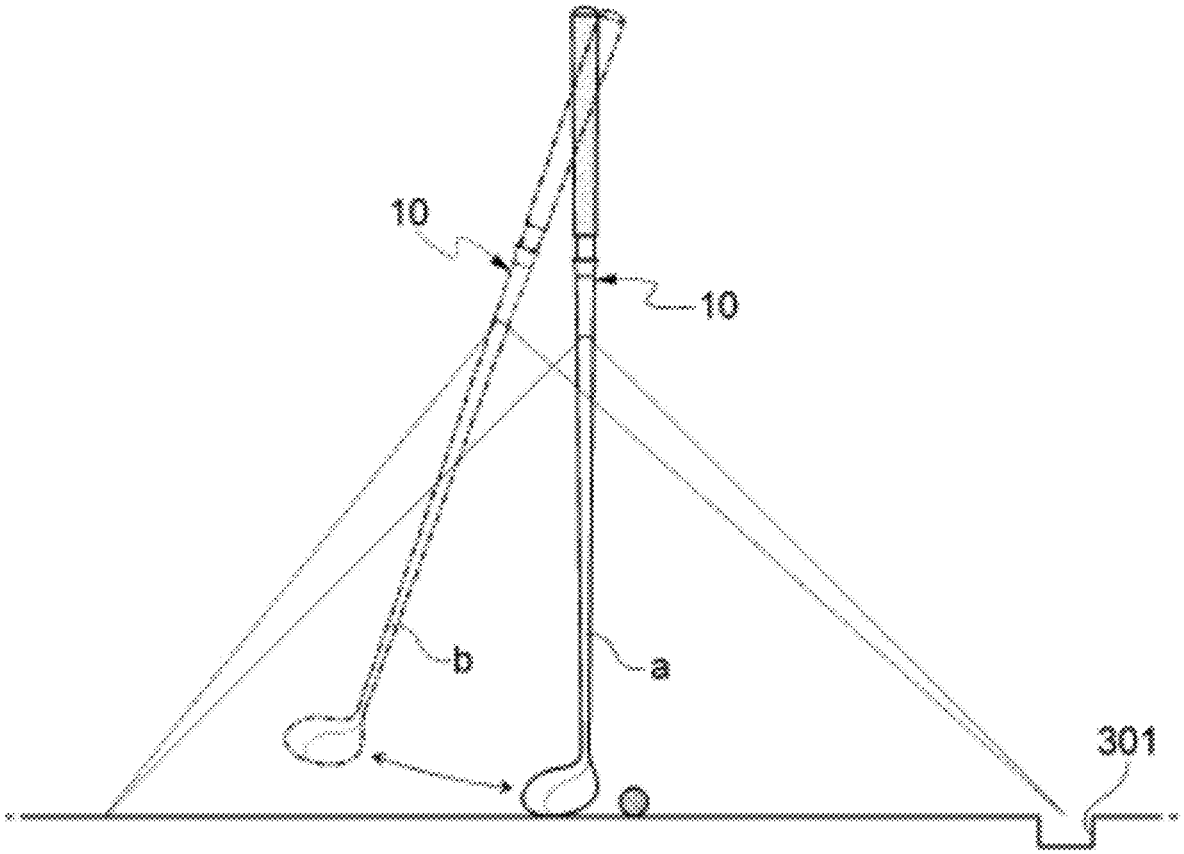
FIGS. 6 to 8 are diagrams showing the guide light emitting device according to an embodiment of the present disclosure.

FIG. 6 is a diagram showing the guide light emitting device according to an embodiment of the present disclosure.

Referring to FIG. 6, if the golf club moves from (a) to (b) by swing, the length of the guide light and the position of the guide light may be changed. At this time, the control unit 280 may sense the movement of the golf club and detect a position change amount of the golf club by using a measurement value of a motion detection sensor that detects motion, such as a gyro sensor, an acceleration sensor, and the like. In addition, the control unit 280 may control the light emitting unit 230 or the lens 270 based on the detected position change amount so that guide light is provided at a certain length or location.

Through this, the control unit 280 may provide the guide light to the user at a certain length and position even when the golf club is moving.

Referring to FIG. 3 again, if the angle formed by the auxiliary apparatus 10 for a golf putter to the ground or the horizontal surface is equal to or less than a predetermined angle, the control unit 280 may determine that the user is not using the auxiliary apparatus 10 for a golf putter, and control the auxiliary apparatus 10 for a golf putter into a power-on-suspend mode. Here, the predetermined angle may be in the range of 0 degrees to 10 degrees, and the range of the predetermined angle may be changed according to a setting of the user.

In addition, if the auxiliary apparatus 10 for a golf putter is not shaken for a predetermined time, the control unit 280 may determine that the user is not using the auxiliary apparatus 10 for a golf putter, and control the auxiliary apparatus 10 for a golf putter into a power-on-suspend mode. Here, the predetermined time is preferably 10 minutes, and the predetermined time may be changed according to the setting of the user.

In addition, the control unit 280 may control the light emitting unit 230 so that the distance is displayed on the guide light together. Here, the distance means a distance away from the hole.

This will be described in detail with reference to FIG. 7.

Figure 7:
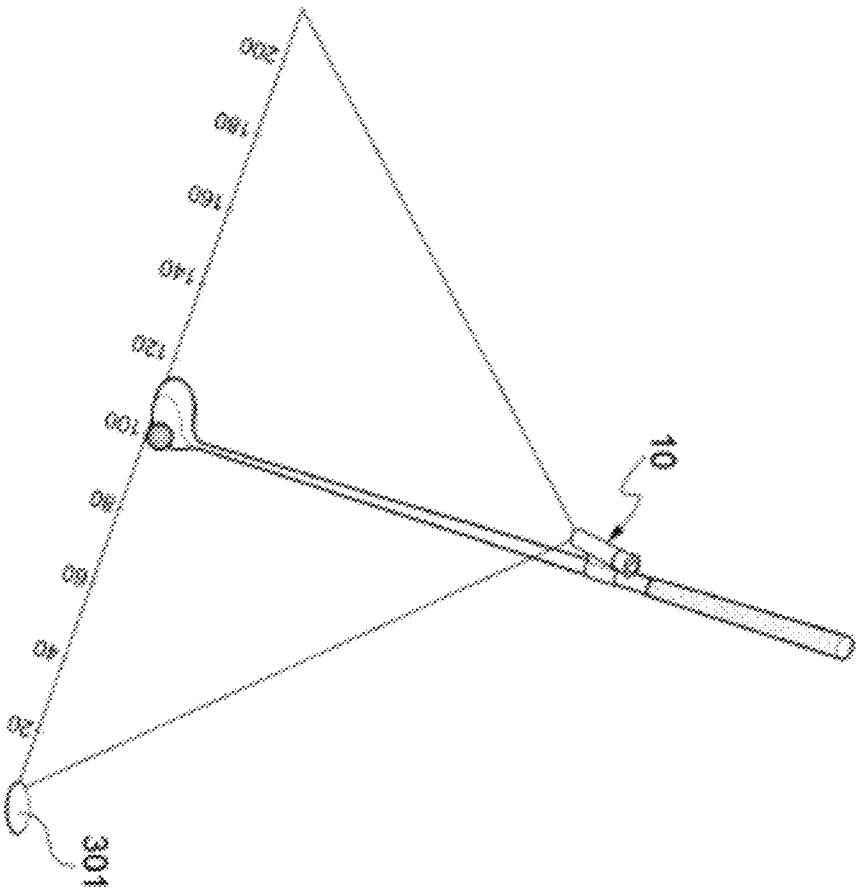

FIG. 7 is a diagram showing the guide light emitting device according to an embodiment of the present disclosure.

Referring to FIG. 7, the control unit 280 may control the light emitting unit 230 to display the distance from the hole at a side of the guide light. Here, the distance indicated at the guide light may be displayed at predetermined intervals. In this example, the predetermined interval is shown as 20 cm, but the predetermined interval may be displayed differently according to user control. In addition, the control unit 280 may control the light emitting unit 230 to emit not only the distance but also information necessary for putting together with the guide light. Here, the information necessary for putting may be the angle of the ground, the direction of the wind, or the intensity of the wind. That is, the control unit 280 may control the light emitting unit 230 to emit at least one of the distance to the hole, the angle of the ground, the direction of the wind and the intensity of the wind together with the guide light.

In the present disclosure, the user may intuitively grasp the distance between the golf ball and the hole by displaying the distance together in the guide light. In addition, the present disclosure has an advantage of helping the putting of the user by displaying the information necessary for putting together with the guide light.

Referring to FIG. 3 again, the control unit 280 may generate a slow motion image corresponding to image for golf putting photographed by the photographing unit 260. In addition, the control unit 280 may control the generated slow motion image to be stored in the storage unit 250, and the control unit 280 may control the generated slow motion image to be transmitted to the mobile device or the peripheral device through the communication unit 240. According to the present invention, the golfer may more accurately diagnose the problem in the putting process through the slow motion image.

In addition, the control unit 280 may control the light emitting unit 230 to adjust the direction and the line length of the guide light based on the stored specifications of the putter. Here, the specifications of the putter may include all specifications that affect the movement of the golf ball, such as the elasticity of the putter, the loft angle and the lie angle. Here, the loft angle means an angle between a vertical line from the ground and a face surface (the surface where the golf ball contacts), and the lie angle means an angle between the ground and the shaft when the head is placed on the ground.

Specifically, as the elasticity is higher or the loft angle is greater among the specifications of the putter, the flight distance is increased. Accordingly, the control unit 280 may control the light emitting unit 230 such that the line length of the guide light becomes longer as the elasticity or the loft angle included in the stored specifications of the putter increases.

In addition, among the specifications of the putter, the loft angle affects the directionality of the golf ball. Also, if the lie angle is large, the loft angle may be bent to the left, and if the lie angle is small, the loft angle may be bent to the right based on the direction of observing the hole from the golf ball. Thus, the control unit 280 may control the light emitting unit 230 to adjust the direction of the guide light according to the loft angle included in the stored specifications of the putter.

Meanwhile, even though only the specifications of the putter are mentioned in the present disclosure, the present disclosure is not limited thereto, and specifications of other types of putters or golf clubs may also be used.

In addition, the control unit 280 may control the light emitting unit 230 to adjust the direction and the line length of the guide light based on the stored golf course information or the received golf course information. That is, the control unit 280 may control the light emitting unit 230 to adjust the direction and the line length of the guide light in consideration of the ground angle or the turf condition. For example, in a course where the ground angle is inclined to the left, the control unit 280 may control the light emitting unit 230 to emit the guide light that is curved to the left.

In addition, the control unit 280 may control the light emitting unit 230 to adjust the direction and the line length of the guide light based on the stored surrounding weather information or the received surrounding weather information. That is, the control unit 280 may control the light emitting unit 230 to adjust the direction and the line length of the guide light in consideration of the surrounding weather information such as wind direction or temperature. For example, if the wind blows to the right based on the direction of observing the hole from the golf ball, the control unit 280 may control the light emitting unit 230 to emit the guide light that is bent to the left based on the direction of observing the hole.

Hereinafter, the control unit that controls the light emitting unit 230 will be described with reference to FIG. 8.

Figure 8:
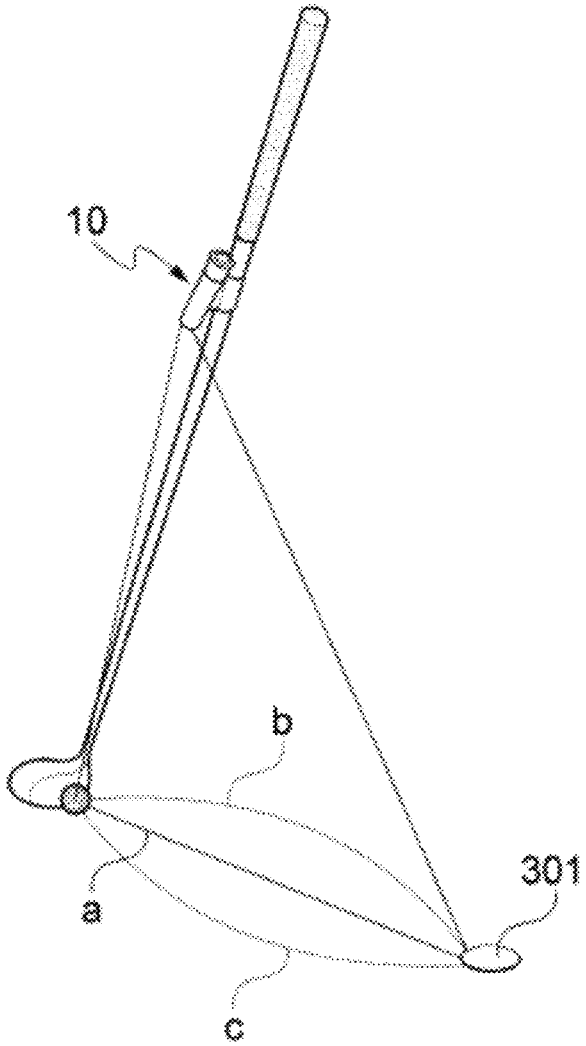

FIG. 8 is a diagram showing the guide light emitting device according to an embodiment of the present disclosure.

Referring to FIG. 8, in general cases, the control unit 280 may control the light emitting unit 230 such that the guide light is a straight line from the golf ball to the hole 301 as shown in (a). Here, the general case means a case where the surrounding weather information, the course information and the putter or golf club specifications do not affect the moving direction of the golf ball.

In addition, the control unit 280 may the light emitting unit 230 to emit the guide light corresponding to the moving direction of the golf ball in consideration of at least one of the surrounding weather information, the course information and the putter or golf club specifications. For example, the control unit 280 may control the light emitting unit 230 so that a curved guide light like (b) or (c) of FIG. 8 is emitted in consideration of at least one of the surrounding weather information, the course information and the putter or golf club specifications. In the present disclosure, since the guide light is provided in consideration of at least one of the surrounding weather information, the course information and the putter or golf club specifications, the user may more easily figure out the direction of the golf ball. In addition, since various conditions are put into consideration, a more accurate guide light may be provided to the user.

Meanwhile, in the present disclosure, since the guide light that guides an estimated path of the golf ball is provided in consideration of at least one of the surrounding weather information, the course information and the putter or golf club specifications, it is possible to help putting.

Meanwhile, terms such as "first", "second", "third" and "fourth" in the specification and claims, if any, are used to distinguish similar elements from each other, and may be used describe a specific sequence or occurrence order, although not exactly. It will be understood that the terms used as above are compatible under appropriate circumstances so that the embodiment of the present disclosure described herein may be implemented in a sequence other than those illustrated or described herein, for example. Likewise, if a method is described as including a series of steps, the order of such steps presented herein is not necessarily the order in which such steps have to be performed, and any described steps may be omitted and/or is already omitted, and any other steps not described herein may be added to the method.

Also, the terms "left", "right", "front", "back", "top", "bottom", "above", "below", and the like in the specification and claims are used for explanation, and are not necessarily to describe invariable relative positions. It will be understood that the terms used as above are compatible under appropriate circumstances so that the embodiments of the present disclosure described herein may be implemented in other directions than those illustrated or described herein, for example. The term "connected" as used herein is defined as being directly or indirectly connected in an electrical or mechanical manner. Objects described herein as "close" to one another may be physically in contact with one another, in close proximity to one another, or in the same general scope or area as appropriate for the context in which the phrase is used. Herein, the presence of the phrase "in an embodiment" means the same embodiment, although not exactly.

In addition, in the specification and claims, various variations of the expressions such as 'connected', 'connecting', 'fastened', 'fastening', 'coupled', 'coupling', and the like are used to mean that any component is directly connected to another component, or indirectly connected through still another component.

In addition, the terms "module" and "unit" used at the end of component names described in the present specification are given or used only considering the ease of writing the specification, and do not have any meanings or roles that are distinguished from each other.

Also, the terms used in this specification are for describing the embodiments and are not intended to limit the present disclosure. In this specification, a singular form also includes a plural form unless otherwise specified in the phrase. The terms 'comprise' and/or 'comprising' used in the specification do not exclude the presence or addition of at least one further component, step, operation and/or element, in addition to the components, steps, operations and/or elements mentioned therein.

The above description is merely illustrative of the technical idea of the present disclosure, and those of ordinary skill in the technical field to which the present disclosure belongs may make various modifications, changes and substitutions without departing from the essential characteristics of the present disclosure.

Therefore, the embodiments disclosed in the present disclosure and the accompanying drawings are not intended to limit the technical idea of the present disclosure, but are intended to explain the technical idea, and the scope of the technical idea of the present disclosure is not limited by these embodiments and the accompanying drawings. The scope of the present disclosure should be interpreted by the appended claims, and all technical ideas within the equivalent scope thereof should be interpreted as being included in the scope of the present disclosure.

INDUSTRIAL APPLICABILITY

The present disclosure may be used in the golf industry.

What is claimed is:

1. An auxiliary apparatus for a golf putter, comprising:

a coupling member detachably coupled to a shaft of the golf putter; and a guide light emitting device coupled to the coupling member and configured to emit a guide light to help golf putting, wherein the coupling member includes:

a first coupling member opened at upper and lower portions and one side thereof and detachably coupled to the golf putter through the opened space; and a second coupling member extending from the first coupling member and opened at upper and lower portions thereof, the second coupling member being configured to accommodate the guide light emitting device through the opened space, wherein the guide light emitting device includes:

a housing;

a battery located at one side inside the housing and configured to supply a power for operating the guide light emitting device;

a light emitting unit configured to emit a guide light based on the supplied power; and a control unit configured to select a light emitting mode and control the light emitting unit so that the guide light is emitted to correspond to the light emitting mode, wherein the guide light emitting device is detachably coupled in the opened space formed in the second coupling member and has a cylindrical shape elongated vertically, and the guide light emitting device is inserted into the second coupling member to be rotatable therein.

2. The auxiliary apparatus for a golf putter according to claim 1, wherein the housing includes a head portion having a first diameter and a body portion having a second diameter smaller than the first diameter, a button for controlling an operation of the guide light emitting device is formed at an outer side of the head portion, the light emitting unit is formed inside the body portion, and the battery is positioned between the button and the light emitting unit.

3. The auxiliary apparatus for a golf putter according to claim 2, wherein the guide light emitting device further includes a lens located close to the light emitting unit to refract the guide light.

4. The auxiliary apparatus for a golf putter according to claim 3, wherein the control unit selects one light emitting mode according to a user input among a straight light emitting mode, a cross light emitting mode and a point light emitting mode, and emits a guide light corresponding to the selected light emitting mode.

5. The auxiliary apparatus for a golf putter according to claim 4, wherein the control unit controls the light emitting unit to adjust a line length of the guide light according to a distance between the auxiliary apparatus for a golf putter and the ground.

6. The auxiliary apparatus for a golf putter according to claim 2, further comprising:

a storage unit configured to store specifications of the golf putter, wherein the control unit controls the light emitting unit to adjust a direction of the guide light based on the stored specifications of the golf putter.

7. The auxiliary apparatus for a golf putter according to claim 1, further comprising:

a photographing unit configured to photograph an image for golf putting, wherein the control unit generates a slow motion image corresponding to the photographed image and store the slow motion image in a storage unit.

* * * * *